United States Patent [19]

Swanson

[11] 4,248,695

[45] Feb. 3, 1981

[54] DESULFURIZING A FUEL WITH ALKANOL-ALKALI METAL HYDROSULFIDE SOLUTION

[76] Inventor: Rollan Swanson, 220 California Ave., Santa Monica, Calif. 90403

[21] Appl. No.: 80,213

[22] Filed: Oct. 1, 1979

Related U.S. Application Data

[63] Continuation-in-part of Ser. No. 927,885, Jul. 25, 1978, abandoned.

[51] Int. Cl.[3] ..... C10G 19/08; C10G 21/16

[52] U.S. Cl. ..... 208/232; 208/208 R; 208/234

[58] Field of Search ..... 208/230–234, 208/107–108, 208 R

[56] References Cited

U.S. PATENT DOCUMENTS

| | | | |
|---|---|---|---|
| 1,899,042 | 2/1933 | Malisoff | 208/232 |
| 1,940,726 | 12/1933 | Morrell | 208/232 |
| 2,360,537 | 10/1944 | Ayers et al. | 208/233 |
| 2,549,052 | 4/1951 | Brown et al. | 208/233 |
| 4,119,528 | 10/1978 | Baird et al. | 208/108 |

*Primary Examiner*—Delbert E. Gantz
*Assistant Examiner*—G. E. Schmitkons
*Attorney, Agent, or Firm*—Albert F. Kronman

[57] ABSTRACT

Petroleum crude and certain liquid distillate fractions derived therefrom, and other sulfur containing fuels or residues are reduced in sulfur content by intimately contacting the fuel or residues with alkanol solutions of alkali metal hydrosulfides, at temperatures and pressures from ambient up to the critical temperature of the alkanol for from 1 to 20 minutes. Thereafter, the fuel is caused to separate from the alkanol solution by the addition of water. A liquid-liquid separation separates desulfurized fuel from the alkanol solution. Hydrogen sulfide formed in the process is used to re-generate alkali metal hydrosulfide for use in desulfurizing additional petroleum fuel.

10 Claims, No Drawings

DESULFURIZING A FUEL WITH ALKANOL-ALKALI METAL HYDROSULFIDE SOLUTION

This application is a continuation-in-part of co-pending application, Ser. No. 927,885 filed July 25, 1978, now abandoned.

This invention relates generally to a low temperature process for desulfurizing various sulfur containing fuels and residues.

The removal of sulfur and sulfur compounds from crude and distillate petroleum fractions and residues has long been of interest to the petroleum industry. On most lower boiling distillates such as gasoline, diesel fuel, and distillate fuel oil, specifications have been established limiting the amount of sulfur that may be left in the product; consequently, considerable effort has been made to develop processes for removing sulfur from these distillates.

Various classifications can be devised for the desulfurization processes applied to sulfur compounds in petroleum, but one convenient method is to classify them as treating and extraction processes, thermal and contact-catalyst processes, and hydrodesulfurization processes. These processes are generally characterized by the use of high temperatures and/or pressures.

Desulfurization of sulfur containing fuels such as petroleum crude or residues in accordance with the present invention is accomplished as follows:

1. Sodium or preferably potassium hydrosulfide (or mixtures of alkali metal sulfide or alkali metal hydrosulfide) are made up in a concentration range of 1% to a saturated solution in lower alkanols ($C_1$–$C_5$).

2. At temperatures and pressures from ambient up to the critical temperature of the particular alkanol and alkanol solution of alkali metal hydrosulfide is intimately contacted with petroleum crude or residue.

3. Depending upon the temperature of the process the alkanol is separated either by distillation during the desulfuring or by the addition of water.

The reagents for the process of this invention are the alkali metal hydrosulfides, alkali metal sulfides and alkali metal polysulfides. The preferred reagents are potassium hydrosulfide and potassium sulfides of lower sulfur content. Sodium and potassium monosulfides are not very soluble in ethanol but are more soluble in methanol. This lack of great solubility makes sodium or potassium sulfides less desirable for use as the reagent of this invention than the hydrosulfides of these metals.

The hydrosulfides of the alkali metals are alkanol soluble, particularly in lower alkanols such as methanol or ethanol. The solubility decreases, in higher alkanols and there is an increase in the difficulty of separating higher alkanols from petroleum crudes and residues. The solvents are methanol, ethanol, 1-propanol and 1-butanol. Ethanol and methanol are the preferred solvents.

The concentration of the hydrosulfide or potassium in methanol is between 0.3 grams/ml of methanol to 0.5 grams/ml of methanol. In ethanol, the potassium hydrosulfide concentration is approximately 0.24 grams of potassium hydrosulfide/ml of solution, (i.e. each ml of the solution will contain 0.24 grams of KHS).

The minimum ratio of alkali metal hydrosulfide to be used is relative to the sulfur content of the petroleum crude or residue to be de-sulfured. The minimum ratio is calculated as follows:

The amount of sulfur in grams divided by 64 (the weight of 2 S) times the molecular weight of KHS (72) divided by the number of grams of KHS/ml of solution = minimal volume of reagent to be used. With sodium hydrosulfide the calculation is the amount of sulfur in grams divided by 48, times the molecular weight of NeHS divided by the number of grams of NaHS per ml solution = the minimal volume of alkanolic NaHS to be used. The basic reaction is:

$$KHS + \text{organic S } (2\ S) = \tfrac{1}{2}\ K_2S_5 + \tfrac{1}{2}\ H_2S$$

$$NaHS + \text{organic S } (1\tfrac{1}{2}\ S) = \tfrac{1}{2}\ Na_2S_4 + \tfrac{1}{2}\ H_2S$$

With potassium hydrosulfide it is desirable to have the water content of the alkanolic KHS solution below that of KHS $\frac{1}{2}$ $H_2O$ in order to maintain the KHS without decomposition of $H_2S$ and KOH. Some decomposition occurs and leaves $K_2S$ because the KOH of this decomposition reacts with undecomposed KHS to form $K_2S + H_2O$. Sodium hydrosulfide is less susceptible to this decomposition. However, the presence of water in the system decreases the ability of the alkanol to penetrate the petroleum crude or residue and to carry the reagent to the sulfur containing parts of the crude or residue.

The $H_2S$ formed in the reaction, both by decomposition of the hydrosulfide and by the reaction to form the polysulfide is used to form new reagent from KOH or NaOH.

To increase the desulfuring ability of the reagent and to preclude formation of heavier molecules of the hydrocarbon, it is desirable to conduct the desulfuring under a hydrogen atmosphere at atmospheric or slightly increased pressures. The pressure within the system is determined by the temperatures used.

If water is present in the petroleum crude or residue or in the reagent above that of the $\frac{1}{2}$ hydrate of KHS vigorous agitation is necessary to desulfur the crude or residue due to the lack of penetration of the petroleum crude or residue by the alkanol carrying the reagent.

Reagent Recycling

The polysulfides of potassium are sufficiently hydrolyzed to KOH and KHS to form potassium hydrosulfide. Potassium hydrosulfide does not acquire sulfur in aqueous solution and the sulfur in excess of the sulfur of the hydro-sulfide ion is expelled as elemental sulfur when the solution is below 55° F. in a closed system. This elemental sulfur is separated by a liquid-solid separation. The water is removed and the solid potassium hydrosulfide is dissolved in alkanol to re-constitute the process reagent.

Aqueous solutions of sodium tetra sulfide can be decomposed to sodium sulfide and elemental sulfur by boiling the solutions under an atmosphere containing neither oxygen nor carbon dioxide. The hydrogen sulfide evolved in the de-sulfurizing reaction is used to form potassium or sodium hydrosulfide by reaction with either potassium or sodium hydroxide or their sulfides.

The invention is illustrated in non-limiting fashion by the following examples:

EXAMPLE I 50 ml of an 11% solution of a mixture containing (80% KHS and 20% $K_2S$) in absolute ethanol was well agitated by shaking with 100 ml of 3.9% sulfur content petroleum crude, at 82° F. at atmospheric pressure for one minute, agitation was stopped and the mixture was chilled to 37° F. The petroleum crude formed a heavy mass at the bottom of the alkanol solution. Thereafter, a liquid-liquid separation was made.

EXAMPLE II

A 3.9% petroleum crude was treated with almost pure KHS with the same volume and condition used in Example I three runs were made with the same 50 ml of reagent. The infrared residual sulfur content of the petroleum crude was 1.6% from the combined three runs.

EXAMPLE III 50 ml of sodium hydrosulfide as a 10% alkanol solution was mixed with 3.9% sulfur content petroleum crude for one minute. The mixture was chilled to 37° F. The separated petroleum crude had a sulfur content of 0.9%. This 0.9% was an average of three desulfuring treatments with the same sodium hydrosulfide alkanol solution.

EXAMPLE IV

Potassium hydrosulfide was made up in methanol and the methanol and the water formed in the making of the potassium hydrosulfide was removed under reduced pressure at 10 mm Hg pressure and no heat supplied. The partial pressure of the water allowed its removal along with the methanol to an acceptable level.

The potassium hydrosulfide was made up as a 0.37 grams/ml reagent in fresh methanol. 200 grams of light Arabian crude containing 1.8% sulfur of 3.6 grams/200 grams was treated with 12 ml of this solution. The solution was allowed to stand for five days, another identical solution for ten days and the final identical solution for thirty days, in glass stoppered flasks with occasional swirling. No heat nor hydrogen atmosphere were supplied.

After the time periods listed above, each of the samples were treated with 1.5 ml of distilled water and well agitated. The samples were centrifuged at 9,000 rpm for twenty minutes. The methanol was recovered from both the top and the bottom of the mix. The procedure (water wash) was repeated two more times. The top layer of methanol was poured off and then blotted off with a paper towel and the bottom layer of methanol-water-reagent was pipetted from the centrifuge tube.

The analysis for the five day sample gave a sulfur reading of 1.3% sulfur, the analysis for the ten day sample gave a sulfur reading of 1.03% and the thirty day sample gave a sulfur analysis of 0.89%.

EXAMPLE V

The thirty day sample was again run with highly de-watered KHS and gave a sulfur reading of 0.135%.

EXAMPLE VI

An Israeli vis-broken petroleum residue with 3.4% sulfur was treated with an ethanolic solution of KHS containing 0.24 grams of KHS/ml. 30 ml of this reagent were used. This vis-broken residue has a specific gravity of 1.026.

The residue was placed in a separatory funnel heated by a heating tape-controlled by a Powerstat and stirred with an overhead stirrer through a ground glass sleeve to keep the system relatively free of atmospheric oxygen. The mix was heated to 110° C. and the ethanol was distilled via the equalization tube of the separatory funnel and collected in a condensation flask. The condensation flask had a vertical water-cooled condenser fitted to insure that escaping ethanol would be liquefied and drain back into the condensation flask.

When the ethanol had been largely distilled, the solution was cooled to below 100° C. and 6 ml of water was added. Agitation was again supplied for three minutes. The agitation was stopped and a solution containing the potassium hydrosulfide-polysulfide reagent collected in the bottom of the separatory funnel. This solution was separated via the stopcock at the bottom of the separatory funnel. The petroleum residue was then removed and brought to boiling with water two times.

The petroleum residue was separated from the water by putting the boiling water-residue into a water-wet #2 filter paper. The water passed the paper but the residue did not. The residue had been lightened and was now lighter than the water. It was necessary to measure the amount of water used to wash the residue and the amount of water recovered in the filtration separation to insure that water was not left in the residue.

The sample was centrifuged after the last water wash. The sample showed 0.79% sulfur upon analysis.

EXAMPLE VII

An Exxon 650+bottoms residue containing 3.2% sulfur was treated identically as the Israeli residue. The de-sulfured petroleum residue showed a final sulfur analysis of 1.3% (1 water wash only).

Having thus finally described the invention what is claimed and desired to be secured by Letters Patent is:

1. A process for desulfurizing a sulfur-containing fuel comprising contacting said fuel with a (lower) primary alkanol solution containing an alkali metal hydrosulfide at a temperature and pressure from ambient up to the critical temperature of the alkanol solvent, the water content of said solution being below that which will cause said hydrosulfide to decompose into $K_2S$ hydroxide, and separating said fuel from said alkanol solution now containing the corresponding higher sulfur content alkali metal polysulfide with the proviso that the volume ratio of said alkanol solution to said fuel is determined by the gram mols of sulfur present in the fuel divided by $1\frac{1}{2}$ gram mols of sulfur, when sodium is the alkali metal, times the molecular weight of sodium hydrosulfide divided by the number of grams of sodium hydrosulfide per milliliters of the alkanol solution and the volume ratio of said alkanol solution to said fuel is determined by the gram mols of sulfur present in the fuel divided by 2 gram mols of sulfur, when potassium is the alkali metal, times the molecular weight of potassium hydrosulfide divided by the number of grams of potassium hydrosulfide per milliliters of the alkanol solution.

2. The process of claim 1, wherein said alkali metal is sodium or potassium and said polysulfides are sodium tetrasulfide or potassium pentasulfide.

3. The process of claim 2 in which the hydrogen sulfide formed in the process is passed through the water solution of the separated alkali metal polysulfide under pressure while being cooled to not less than 55° F.

4. The process of claim 1, wherein said contacting takes place for between one minute and twenty minutes.

5. The process of claim 1, wherein said hydrosulfide is potassium hydrosulfide and said contacting takes place for a period of 5 to 30 days at ambient temperature.

6. The process of claim 1, wherein the concentration of the alcohol solution, when ethanol is the alcohol, is of the order of 0.24 grams of potassium hydrosulfide per milliliter of solution.

7. The process of claim 1, wherein the alkali metal hydrosulfide concentration in said solution ranges from one percent to saturation.

8. The process of claim 1, further including the step of adding 10% water to said separated alkanol solution when the alcohol is below boiling temperatures to separate the alcohol and the polysulfide from the fuel.

9. The process of claim 1, in which water in an amount of not more than one half of the volume of the alkanol is added to dissolve the alkali metal polysulfide to form a concentrated solution in water which separates from the fuel.

10. The process of claim 1, wherein said alkanol solution contains also an alkali metal sulfide in a minor amount.

* * * * *